US005471712A

United States Patent [19]

Kroyer

[11] Patent Number: 5,471,712

[45] Date of Patent: Dec. 5, 1995

[54] ADJUSTABLE SCREEN FOR A DISTRIBUTION FOR MAKING A SHEET-FORMED FIBROUS PRODUCT

[76] Inventor: Karl K. K. Kroyer, Le Vieux Moulin, 12, rue de la Libération, F-06520 Magagnosc, France

[21] Appl. No.: 141,935

[22] Filed: Oct. 28, 1993

[51] Int. Cl.[6] ..... D01G 25/00; B21F 27/02; B28B 5/00

[52] U.S. Cl. ..... 19/304; 19/148; 140/9; 245/8; 425/83.1

[58] Field of Search ..... 19/148, 296, 304, 19/307, 308; 209/310, 394, 404, 413; 160/371, 372, 375; 245/8; 140/7, 9, 4, 5; 425/82.1, 83.1

[56] References Cited

U.S. PATENT DOCUMENTS

| | | | |
|---|---|---|---|
| 2,464,432 | 3/1949 | Brickman | 140/9 X |
| 3,256,142 | 6/1966 | Devine | 245/8 |
| 3,984,898 | 10/1976 | Matsumura et al. | 425/82.1 X |
| 4,064,051 | 12/1977 | Wehner | 209/310 X |
| 4,106,163 | 8/1978 | Desverchére | 19/296 |
| 4,157,236 | 6/1979 | Busker et al. | 19/296 X |
| 4,169,699 | 10/1979 | Werner | 19/308 X |
| 4,264,289 | 4/1981 | Day | 425/83.1 |
| 4,732,670 | 3/1988 | Nelson | 209/404 X |
| 5,029,779 | 7/1991 | Bruggeman | 140/92 X |
| 5,093,963 | 3/1992 | Farrington et al. | 19/296 |

*Primary Examiner*—C. D. Crowder
*Assistant Examiner*—Ismall Izaguirre
*Attorney, Agent, or Firm*—Watson, Cole, Grindle & Watson

[57] ABSTRACT

An apparatus for making a sheet formed fiber product includes at least one fiber distributor (1) having a substantially planar bottom (7) in the form of a wire net, with openings approximately formed as parallelograms; an endless forming wire (2) having an upper and an lower run, the upper run being situated a short distance from the underside of the bottom (7) of the fiber distributor (1), and at least one suction box (3) situated in such a way in relation to the upper run (2) of the forming wire that fibers passing through the bottom (7) of the fiber distributor are disposed onto the upper side (2) of the forming wire in the form of a coherent fiber layer.

9 Claims, 3 Drawing Sheets

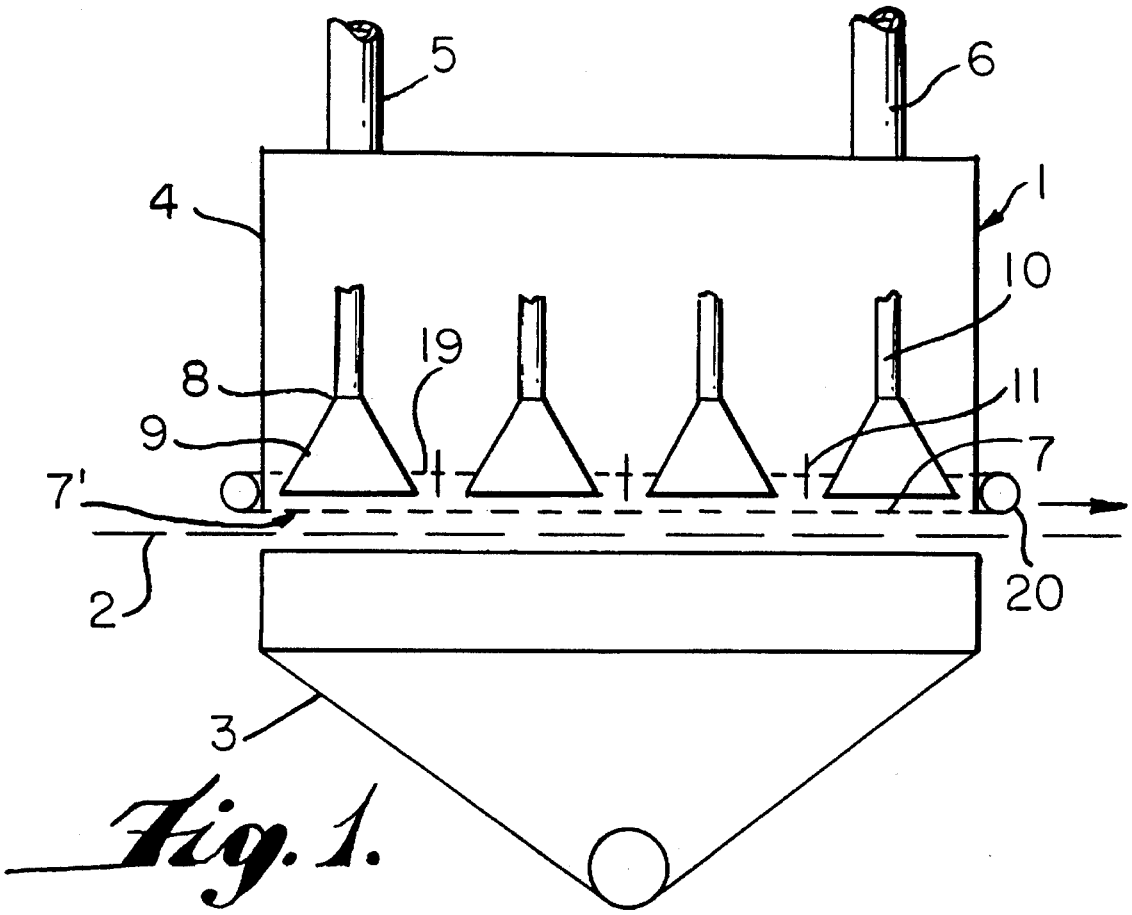
Fig. 1.
Fig. 4.
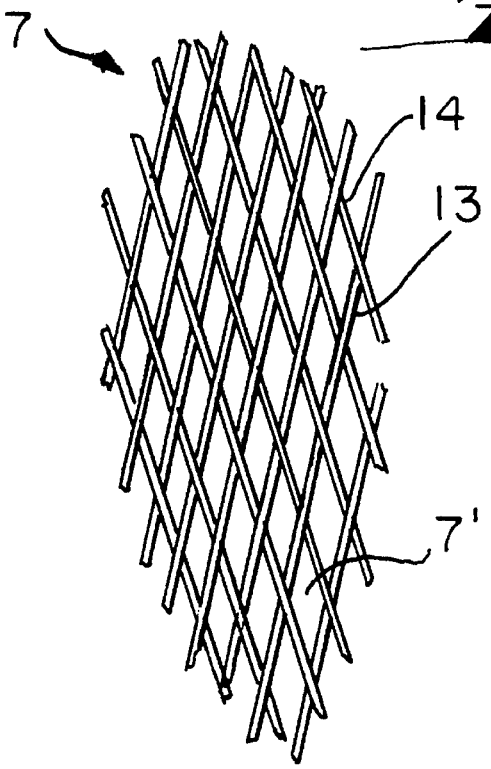

ADJUSTABLE SCREEN FOR A DISTRIBUTION FOR MAKING A SHEET-FORMED FIBROUS PRODUCT

BACKGROUND OF THE INVENTION

The present invention concerns an apparatus for making a sheet-formed fibrous product. The apparatus is intended for use in the so-called dry-forming method, a method by means of which air is used as carrier medium for the fibers for forming the desired sheet-formed fibrous product instead of water, which has been used as carrier medium by the wet method known for centuries.

By such dry-forming method an air stream containing a suspended defibrated cellulosic material is sucked up against an air pervious forming surface such as a wire net by means of a suction box placed onto the opposite side of the net and arranged for sucking air. Hereby a retention of the fibers occurs and thereby a forming of a coherent fiber layer on the forming surface and subsequently the fiber layer may be removed herefrom and be put through different after treatments for obtaining final products with desired physical and chemical qualities.

At an early stage of development in the dry-forming method a defibrator was used, such as a hammer mill, placed in such a way in relation to the forming surface that the defibrated material passed directly from the defibrator onto the forming surface. At a later stage a fiber distributor was placed between the defibrator and the forming surface, the distributor having a bottom in the form of a net having mesh openings which allow passage of single fibers and which restrain fiber agglomerates. The purpose of the fiber distributor is on the one hand to distribute the fiber material uniformly over the forming surface, such as an endless forming wire, and on the other hand to restrain non-defibrated fiber material or fiber agglomerates so that they are not carried onto the forming wire and result in an uneven fiber distribution in the fiber layer formed.

The known apparatuses of the above-mentioned type present the drawback that their velocity of production is substantially less than the velocity of production for the known apparatuses based on the wet method.

It has been tried to eliminate this drawback by increasing the velocity by which the forming wire is forwarded below the bottom of the fiber distributor and by increasing the fiber discharge from the fiber distributor. The aim hereby is to quickly deposit so many fibers onto the forming wire that they form a fiber layer in which the fibers touch each other and form a coherent sheet which may endure to be forwarded with high velocity without being damaged and which is uniform both in the machine direction and in the cross direction, i.e., without the so-called beach effect.

When manufacturing fiber products which substantially consist of cellulosic fibers, fiber distributors having a bottom consisting of a screen in the form of a wire net have been used, where the wires cross each other at acute angles, i.e., having quadratic or rectangular mesh openings. The meshes in the known fiber nets typically have the dimensions 2.5×2.5 mm.

In many situations it has been desirable to manufacture fiber products consisting of a mixture of cellulosic fibers and synthetic organic fibers, such a thermoplastic fibers, fibers having a thermoplastic surface, superabsorbent powder or granulate. By mixing such synthetic organic fibers and/or powder or granulate, fiber products having improved physical properties are obtained, e.g. having increased strength and/or larger ability of absorption.

Synthetic organic fibers, i.e. plastic fibers, necessarily have a greater length than cellulosic fibers and by using mixings of cellulosic fibers and organic synthetic fibers a tendency occurs that the synthetic organic fibers are retained at the bottom of the fiber distributor, whereas the cellulosic fibers pass through the distributor.

If this drawback is attempted to be overcome by increasing the largest dimension of the meshes so much that the synthetic organic fibers are able to pass through the bottom of the fiber distributor, the possibility, however, occurs that the non-defibrated lumps or agglomerates of cellulosic fibers pass through the bottom of the fiber distributor. This causes the fiber layer formed to have a great variation in fiber thickness, i.e., areas of close tangled fibers are formed, so-called fish eyes.

More specifically the present invention relates to a screen formed as a net-formed substantially plane bottom for a fiber distributor of an apparatus for manufacturing a sheet-formed fibrous product which apparatus further comprises a number of stirring wings which may be made to rotate around axes which are substantially perpendicular to the plane bottom, an endless forming wire having an upper and a lower run, the upper run being situated in a short distance from the under side of the bottom, and at least one suction box situation in such a way in relation to the upper run of the forming wire that fibers passing through the bottom are deposited on the upper run of the forming wire as a uniform coherent fiber layer, and means for removing the fiber layer from the forming wire in form of a sheet-formed fibrous product.

Apparatuses of the above-mentioned type are e.g., known from GB patent No. 2,008,638 and U.S. Pat. No. 4,494,278, said patents are hereby incorporated by reference. In these patents apparatuses are described comprising two or more built together fiber distributors.

Such apparatuses have widely been used for dry-forming of sheet-formed cellulosic fibrous products. These cellulosic fibrous products have a great ability to absorb water and are used widely for manufacturing tissues, diapers, incontinence products, sanitary towels and the like.

The object of the invention is to provide an apparatus of the above-mentioned type which makes it possible to manufacture uniform sheet-formed fiber products from mixtures of cellulosic fibers and organic synthetic fibers and with high velocity.

SUMMARY OF THE INVENTION

This object is obtained with the according to the invention which screen is characterized in that it consists of a diagonally stretchable wire net comprising mesh openings substantially having the form of parallelograms.

By using mesh openings having the form of parallelograms having side lengths a and b instead of using rectangular mesh openings having the dimensions a and b, the largest dimension, viz. the largest diagonal of the meshes, are larger at the same time as the light area is smaller. Hereby a passage is possibly of the relative long synthetic organic fibers without increasing risk of passage of fiber lumps and/or agglomerates.

A further advantage of the invention is that the existing fiber distributors in which the bottom consists of wire net having quadratic or rectangular mesh openings at stretching in the diagonal direction of the mesh openings may be changed into net having openings in form of parallelograms.

According to a specific preferred embodiment of the screen according to the invention the screen consists of a net wherein the threads forming the sides of the parallelograms are curved. Such a net may be obtained by diagonally stretching a woven wire net in which the mesh openings are quadratic or rectangular and in which the crossing wire threads are mutually fixated and by fixating the net in the form obtained by the diagonal stretching. The former fixation may be obtained by hard-soldering, e.g., silver soldering the crossings, and the latter fixation may, e.g., be obtained by a metalization such as a chromium-plating or a silver-plating of the net.

Screens according to the invention are especially usable in apparatuses comprising two or several built together fiber distributors situated close above the upper run of one and same forming wire and having one or several suction boxes situated on the opposite side for the upper run of the forming wire.

Such apparatuses are characterized by having an especially high capacity of production and form the fiber product with great uniformity both in the machine direction and in the cross direction.

Apparatuses comprising two or several built together fiber distributors are described in the above-mentioned GB and US patents.

By mixing synthetic thermoplastic fibers into the sheet-formed fibrous product manufactured by means of the screen according to the invention the amount of binder, e.g. in form a latex, may be reduced or the binder may be totally left out. The same applies to the use of fibers having a thermoplastic surface layer. When such a fiber product is heated, e.g., by being carried through a long heater, a softening and/or melting of the thermoplastic fibers is obtained, the fiber product after being re-cooled acts in the same way as a real binder.

BRIEF DESCRIPTION OF THE DRAWINGS

In the drawing,

FIG. 1 shows schematically a section through a preferred embodiment of an apparatus comprising a screen according to the invention seen from the side, FIG. 4 shows a fragmentary view of a screen according to a further embodiment of the invention, seen from above.

DETAILED DESCRIPTION OF THE PREFERRED EMBODIMENT

Figure 2:
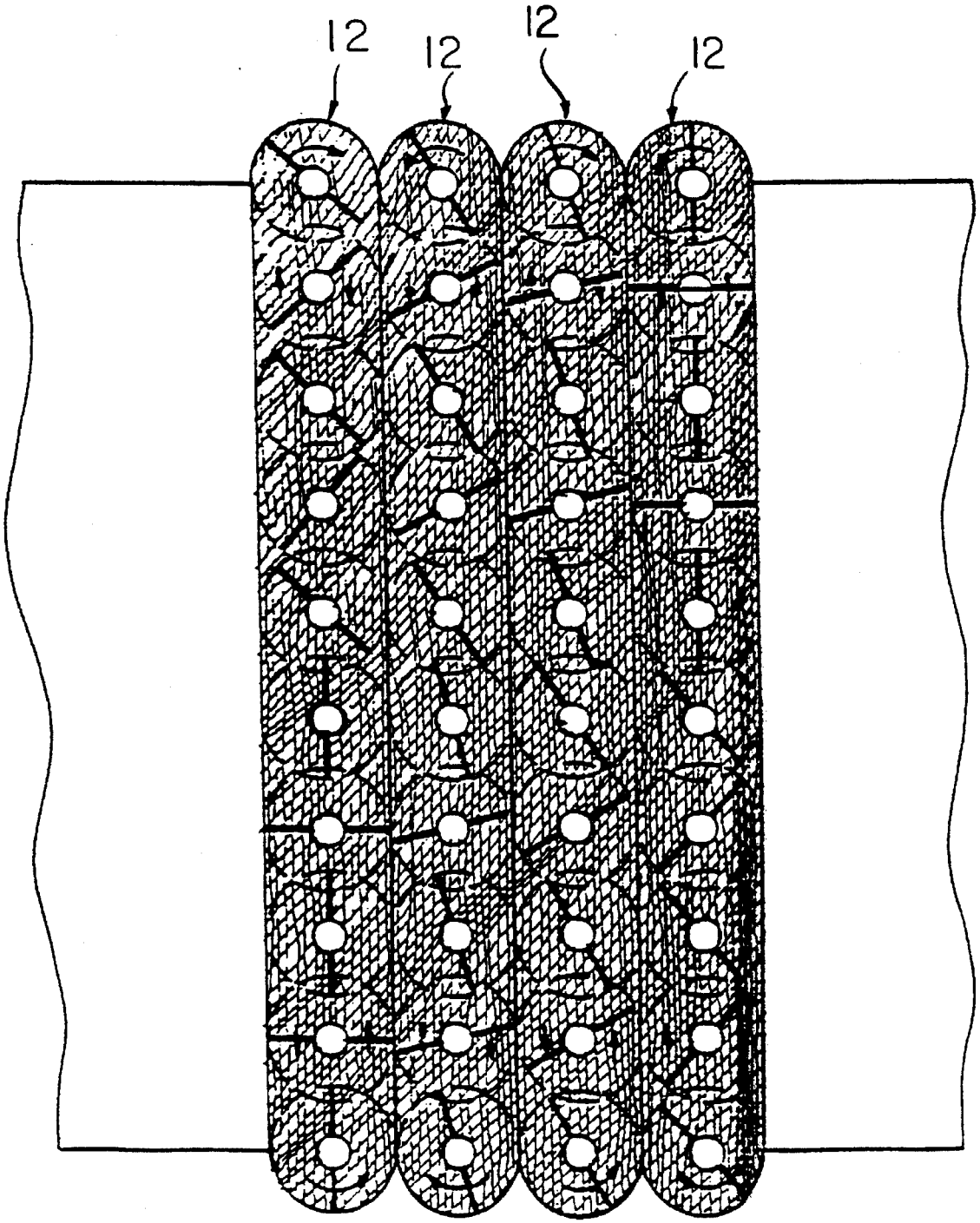
FIG. 2 shows schematically an enlarged fragmentary view of the bottom illustrated in FIG. 1 and the placing of stirring wings in the fiber distributor.

The apparatus shown in FIG. 1 comprises a fiber distributor, which in general is designated 1, a forming wire 2 having an upper and an lower run, of which only the upper is shown, and a suction box 3.

The fiber distributor 1 comprises a housing 4 having a pipe 5 for supplying loose fibers and a second pipe 6 for sucking away fiber agglomerates. The bottom of the house 4 is made of a stretched wire net 7 having mesh openings 7' in form of parallelograms, cf. FIG. 3 and 4.

The wire net 7 is provided with stretching means indicated at 19 and 20. It is noted that only the stretching means 19 effecting a diagonally stretching in one direction is necessary. However, in some circumstances it might be preferred to use stretching means 20 arranged in a direction perpendicular thereto. The stretching means could be of any type making it possible to grip a marginal side area of the net 7 and to exert a tensioning. Thus the stretching means 19,20 might be rollers provided with a pawl-mechanism for maintaining the roller in a position in which the net has been stretched. Such stretching mechanism makes it possible to adjust the net after it has been mounted on the fiber distributor 1. Thus it is possible to vary the quality of the sheet-formed layer formed on the forming wire 2 as a higher or lower degree of stretching would allow passage of minor or greater agglomerates containing few interconnected fibers.

A short distance above the net 7 rows of stirring wings 8 are situated, each having a lower sheet formed part 9 and a shaft 10 which is connected to a mutual driving means. Between the rows of stirring wings 8 low partitions 11 are situated. When operating the stirring wings 8 a so-called race-track is formed on the net 7. This is explained in detail in the above-mentioned patents.

As it appears from FIG. 2 the rows of stirring wings 8 are situated across the forming wire 2 and the areas of the wire net 7 which are swept by the adjacent sheet-formed parts 9 of the stirring wings 8 are partly overlapping. Alternatively the rows of stirring wings 8 could be situated along the forming wire.

The forming wire 2, whose upper run passes below the house 4 in a short distance from the wire 7, consists preferably of an endless woven wire net, e.g., a net consisting of threads of stainless steel or phosphorus bronze.

The mesh width in the forming wire 2 is chosen in such a way that substantially all fibers passing through the wire net 7 are retained on the forming wire 2 upon which a coherent fiber layer is formed.

The suction box 3 situated below the upper run of the forming wire 2 in the area below be house 4 is connected with a suction pipe 12.

The function of the apparatus shown is as follows:

A mixture of defibrated cellulosic material, such as cellulosic pulp, and synthetic single fibers are carried into the housing 4 through the pipe 5.

In the housing 4 the fiber material is exposed to the influence of the stirring wings 8 which sheet-formed parts 9 make the fiber material to form a race-track containing endless sausage-formed bodies which move around in the four zones 12 limited by the outer walls/partitions 11. It is noted that the number of rows may be varied, e.g., up to 12 rows may be used.

During said movement the fiber material is carried over the holes 7' in the wire net 7 and single fibers and small agglomerates are drawn down towards the suction box 3 during influence of the suction from the suction box 3. During this movement the fiber material comes into contact with the forming wire 2 and forms thereon a coherent fiber layer. This fiber layer may if desired be combined with one or several further fiber layers formed by means of other fiber distributors or otherwise, e.g. by the wet method, and the first fiber layer or the combination of fiber layers may be exposed to further treatment, such as addition of a binder, humidifying, embossing, colouring or the like for obtaining a fiber product with desired properties.

Figure 3:
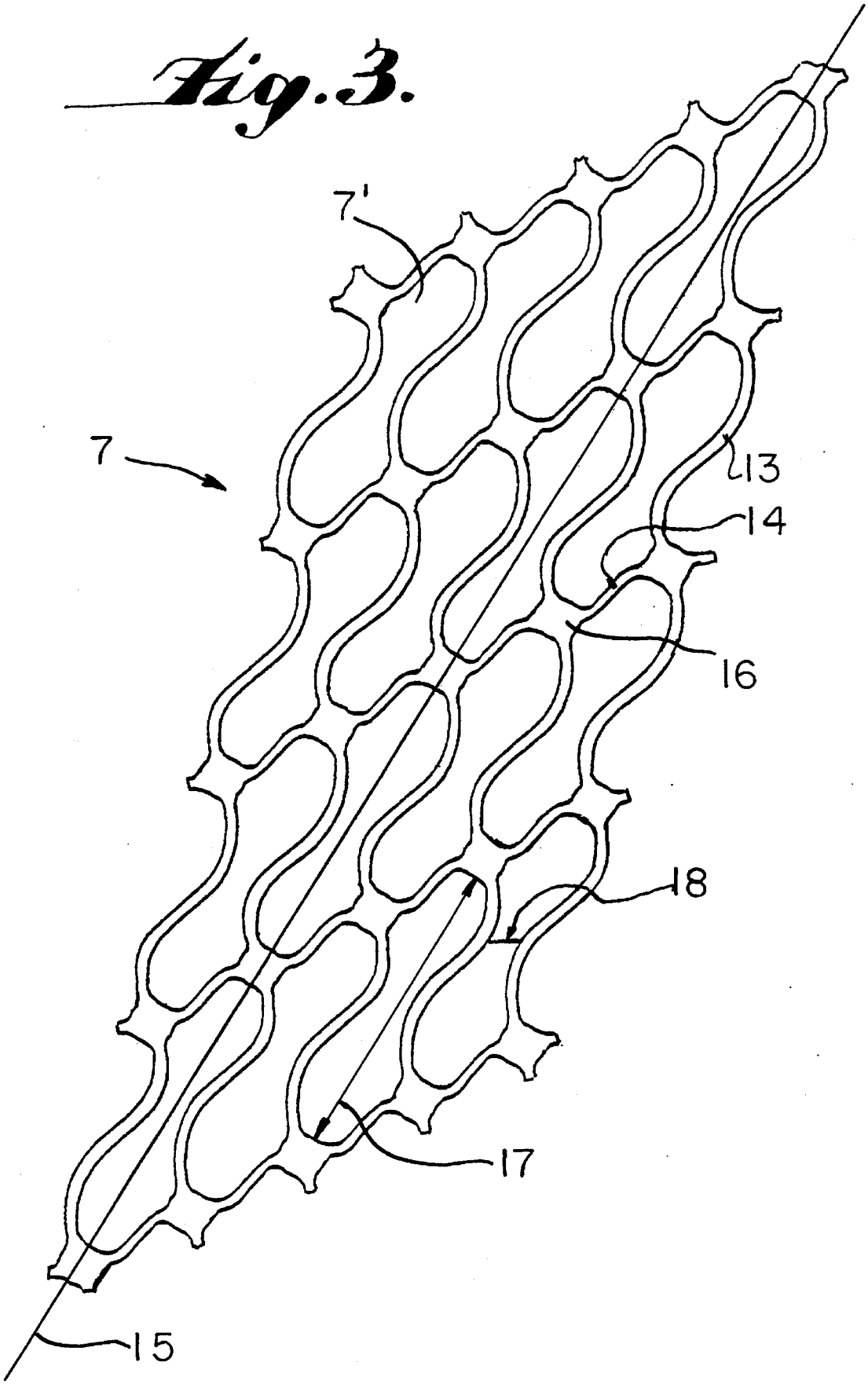
FIG. 3 shows a fragmentary view of a screen according to a preferred embodiment of the invention, seen from above.

As it appears from FIG. 3 the net 7 forming the bottom of the fiber distributor 1 comprises mesh openings 7' in form of parallelograms having curved sides 13,14. The net 7 has been fixated in the illustrated form in which a diagonal stretch has been obtained in a direction indicated by the line 15. The curved sides 13,14 are obtained in that these sides are made from flexible wire threads being fixated in each crossing 16. The fixation of the threads in the crossings 16 is preferably established by hard-soldering, e.g., silver soldering forming a point of restrainment for the sides 13,14. Thus, when stretching the net along the line 15 the mesh openings 7' would obtain the form illustrated. After the stretching the wire net 7 has been fixated in the stretched form preferably by a metalization of the net.

The combination of the curved sides 13,14 and the knurled crossings 16 provides a rugged surface which enhances the reduction of the fiber lumps and fiber agglomerates contained in the sausage-formed bodies.

The mesh openings 7' may have different sizes. However, it is preferred that the sides 13 and 14 in an unstretched state will have a rectangular form having a short dimension between 2 and 5 mm, preferably 3 mm, and a long dimension between 4 and 8 mm, preferably 6 mm. Such dimensions would give raise to stretched mesh openings 7' having a long diagonal dimension 17 of between 6 and 10 mm and a short diagonal dimension 18 transversal to the direction of the stretching of between 1 and 4 mm, preferably between 1 and 2 mm. Accordingly, long synthetic organic fibers could pass through the mesh opening 7 without the risk of passage of fiber lumps and/or agglomerates.

Even though the net 7 thus allows passage of fibers with a greater fiber length than the net having rectangular mesh openings, it does not allow passage of larger fiber agglomerates. On the contrary, the distance between the adjacent metal threads forming the sides 13 and 14 have been reduced by the diagonal stretching.

FIG. 4 illustrates a diagonal stretched wire net 7 in which the crossing wire threads are not fixated in relation to each other. This wire net 7 would provide the benefit of the elongated mesh openings 7', however, it would not provide an effective reduction of the fiber lumps and fiber agglomerates as the net illustrated in FIG. 3. However, the net 7 illustrated in FIG. 4 might be held in the stretched state when using stretching means 19,20 as illustrated in FIG. 1. Thus the net would allow passage of long synthetic-fibers without the risk of passage of fiber lumps or agglomerates.

I claim:

1. The combination of a suction box; an endless forming wire whose upper run passes over said suction box; and a fibre distributor positioned over said upper run and said suction box, said fibre distributor including a bottom and containing a plurality of stirring wings rotatable around axes substantially perpendicular to said bottom, said bottom being formed of a screen comprising a diagonally stretchable wire net of flexible wire threads which are connected at cross-over points to form mesh openings having substantially parallelogram configurations.

2. A combination as defined in claim 1, wherein the wire threads constituting the sides of the parallelograms are curved.

3. A combination as defined in claim 1, wherein the wire threads are connected at said cross-over points by metalization.

4. A combination as defined in claim 1, wherein said screen is chromium-plated.

5. A combination as defined in claim 1, wherein the wire threads are made of metal and wherein the wire threads are connected at said cross-over points by hard-soldering.

6. A combination as defined in claim 5, wherein the hard-soldering is a silver soldering and wherein the wire threads are made of steel.

7. A combination as defined in claim 1, wherein the mesh openings in an unstretched state have a rectangular form having a short dimension between 2 and 5 mm, and a long dimension between 4 and 8 mm, said screen after diagonally stretching having a long dimension between 6 and 10 m, and a short dimension extending transversal to the direction of stretching between 1 and 4 mm.

8. The combination as defined in claim 1, wherein the screen is positioned with a stretching direction orientated in a direction of a so-called race-track formed by the rotatable wings.

9. The combination as defined in claim 1, wherein two sides of the screen oriented perpendicular to the direction of the stretching include tensioning means for adjusting the degree of stretching.

* * * * *